US007997459B2

(12) United States Patent
Warby

(10) Patent No.: US 7,997,459 B2
(45) Date of Patent: Aug. 16, 2011

(54) METERING VALVES FOR DISPENSERS

(75) Inventor: Richard J. Warby, Wisbech (GB)

(73) Assignee: Consort Medical PLC, Hertfordshire (GB)

( * ) Notice: Subject to any disclaimer, the term of this patent is extended or adjusted under 35 U.S.C. 154(b) by 904 days.

(21) Appl. No.: 11/659,786

(22) PCT Filed: Aug. 10, 2005

(86) PCT No.: PCT/GB2005/003132

§ 371 (c)(1),
(2), (4) Date: Nov. 20, 2007

(87) PCT Pub. No.: WO2006/016151

PCT Pub. Date: Feb. 16, 2006

(65) Prior Publication Data

US 2008/0265198 A1 Oct. 30, 2008

(30) Foreign Application Priority Data

Aug. 11, 2004 (GB) ..... 0417908.1

(51) Int. Cl.
*B65D 83/00* (2006.01)

(52) U.S. Cl. ..... 222/402.22; 251/239; 251/234; 222/37

(58) Field of Classification Search ..... 251/234, 251/233, 249, 339, 343, 344, 347, 348, 353, 251/354; 222/23, 36–38, 402.1, 402.2, 402.22–402.25; 128/200.23

See application file for complete search history.

(56) References Cited

U.S. PATENT DOCUMENTS

| | | | | |
|---|---|---|---|---|
| 2,788,925 A | | 4/1957 | Ward | |
| 2,856,103 A | | 10/1958 | Ward | |
| 2,932,432 A | | 4/1960 | Beard | |
| 2,998,168 A | * | 8/1961 | Waldherr | 222/402.2 |
| 3,313,459 A | | 4/1967 | Ryuichi | |
| 3,495,567 A | * | 2/1970 | Gayle et al. | 116/308 |
| 3,586,216 A | | 6/1971 | Jordan et al. | |

(Continued)

FOREIGN PATENT DOCUMENTS

DE 198 25 031 2/1999

(Continued)

OTHER PUBLICATIONS

Combined Search and Examination Report dated Jan. 12, 2005 issued in corresponding Application No. GB0417908.1.

(Continued)

*Primary Examiner* — John K Fristoe, Jr.
*Assistant Examiner* — Marina Tietjen
(74) *Attorney, Agent, or Firm* — Smith, Gambrell & Russell, LLP

(57) ABSTRACT

A metering valve is provided for a pressurised container containing a pharmaceutical formulation. The valve has a stem with a central flange and a hollow open end with a side port. The stem slides in a body having larger and smaller diameter portions, and being closed off by a seal against which the flange rests in an inoperative position. A second seal is located around the stem on the opposite side of the flange and trapped by a spring which urges the stem into its inoperative position. When the stem is depressed, the inner seal forms a sliding seal with the smaller diameter portion of the body to define a metering chamber filled with the pharmaceutical formulation. Continued depression opens the side hole to allow the contents of the metering chamber to be dispensed.

43 Claims, 8 Drawing Sheets

U.S. PATENT DOCUMENTS

| | | | | | |
|---|---|---|---|---|---|
| 3,757,732 | A | * | 9/1973 | Frey, Jr. | 116/299 |
| 3,950,939 | A | * | 4/1976 | Meisner et al. | 368/222 |
| 4,116,370 | A | | 9/1978 | Spitzer et al. | |
| 4,362,257 | A | * | 12/1982 | Shay | 222/402.2 |
| 4,811,868 | A | | 3/1989 | Nitta | |
| 5,211,317 | A | * | 5/1993 | Diamond et al. | 222/394 |
| 5,349,945 | A | * | 9/1994 | Wass et al. | 128/200.23 |
| 5,356,012 | A | * | 10/1994 | Tang et al. | 206/534 |
| 5,421,482 | A | * | 6/1995 | Garby et al. | 222/36 |
| 5,836,299 | A | | 11/1998 | Kwon | |
| 6,006,745 | A | | 12/1999 | Marecki | |
| 6,006,954 | A | | 12/1999 | Warby | |
| 6,047,946 | A | | 4/2000 | Kolanus | |
| 6,076,521 | A | * | 6/2000 | Lindahl et al. | 128/203.15 |
| 6,131,777 | A | | 10/2000 | Warby | |
| 6,170,717 | B1 | | 1/2001 | Di Giovanni et al. | |
| 6,283,365 | B1 | * | 9/2001 | Bason | 235/116 |
| 6,394,321 | B1 | | 5/2002 | Bayer | |
| 6,454,140 | B1 | | 9/2002 | Jinks | |
| 6,474,513 | B2 | | 11/2002 | Burt | |
| 6,615,827 | B2 | * | 9/2003 | Greenwood et al. | 128/200.23 |
| 6,679,251 | B1 | * | 1/2004 | Gallem et al. | 128/200.23 |
| 6,752,153 | B1 | * | 6/2004 | Eckert | 128/205.23 |
| 6,832,704 | B2 | | 12/2004 | Smith | |
| 6,978,915 | B1 | | 12/2005 | Russell | |
| 7,107,986 | B2 | * | 9/2006 | Rand et al. | 128/200.23 |
| 7,137,391 | B2 | * | 11/2006 | Bruna | 128/205.23 |
| 7,143,764 | B1 | * | 12/2006 | Dagsland et al. | 128/203.15 |
| 7,156,258 | B2 | * | 1/2007 | Eckert | 222/23 |
| 7,195,134 | B2 | * | 3/2007 | Ouyang et al. | 222/36 |
| 7,543,582 | B2 | * | 6/2009 | Lu et al. | 128/200.23 |
| 7,575,130 | B2 | * | 8/2009 | Blacker et al. | 222/23 |
| 7,650,883 | B2 | * | 1/2010 | Scarrott et al. | 128/200.23 |
| 7,726,555 | B2 | * | 6/2010 | Minshull et al. | 235/66 |
| 2002/0190085 | A1 | | 12/2002 | Stanford | |
| 2003/0178448 | A1 | | 9/2003 | Warby et al. | |
| 2003/0230602 | A1 | | 12/2003 | Smith | |
| 2003/0230603 | A1 | | 12/2003 | Smith | |
| 2004/0065326 | A1 | * | 4/2004 | MacMichael et al. | 128/205.23 |
| 2004/0134824 | A1 | * | 7/2004 | Chan et al. | 206/524.1 |
| 2004/0139965 | A1 | * | 7/2004 | Greenleaf et al. | 128/200.23 |
| 2004/0221840 | A1 | * | 11/2004 | Stockman-Lamb | 128/200.23 |
| 2005/0011515 | A1 | * | 1/2005 | Lee et al. | 128/200.23 |
| 2006/0151524 | A1 | * | 7/2006 | Stradella et al. | 222/23 |
| 2007/0284383 | A1 | * | 12/2007 | Wright et al. | 221/7 |
| 2008/0135575 | A1 | * | 6/2008 | Ingram et al. | 222/36 |
| 2008/0135584 | A1 | | 6/2008 | Wickham | |
| 2009/0139516 | A1 | * | 6/2009 | Augustyn et al. | 128/200.23 |

FOREIGN PATENT DOCUMENTS

| | | | | |
|---|---|---|---|---|
| EP | 0 190 210 | | | 12/1987 |
| EP | 1 375 385 | A2 | | 1/2004 |
| FR | 2 285 815 | | | 4/1976 |
| FR | 2 568 975 | | | 2/1986 |
| GB | 857115 | | | 12/1960 |
| GB | 864694 | | | 4/1961 |
| GB | 892 166 | | | 3/1962 |
| GB | 1287126 | | | 8/1972 |
| GB | 1336379 | | | 11/1973 |
| GB | 2004526 | | | 4/1979 |
| GB | 2077229 | | | 12/1981 |
| GB | 2086845 | | | 5/1982 |
| GB | 2 124 587 | A | | 2/1984 |
| GB | 2311982 | | | 10/1997 |
| WO | 94/01347 | | | 1/1994 |
| WO | WO04/001664 | | * | 12/2003 |
| WO | WO 2004/022143 | A2 | | 3/2004 |
| WO | WO 2004/069689 | A1 | | 8/2004 |

OTHER PUBLICATIONS

English translation of First Notification of Office Action issued by the Chinese Patent Office on Jun. 26, 2009 for Application No. 200580034276.0.

English translation of Second Notification of Office Action issued by the Chinese Patent Office on Mar. 19, 2010 for Application No. 200580034276.0.

Chinese language Response entitled "Form for Observations" dated Nov. 11, 2009 for Application No. 200580034276.0 together with English translation of accompanying claims.

Combined Search and Examination Report under Sections 17 and 18(3) issued by the UK IPO for Application No. GB0417908.1 dated Jan. 12, 2005.

The Response to First Examination Report dated Aug. 15, 2006 for Application No. GB 0417908.1.

Examination Report under Section 18(3) issued by the UK IPO for Application No. GB 0417908.1 dated Oct. 4, 2006.

The Response to Second Examination Report dated Oct. 23, 2006 for Application No. GB 0417908.1.

International Search Report corresponding to International Application No. PCT/GB2004/000486, dated May 24, 2004.

* cited by examiner

METERING VALVES FOR DISPENSERS

This invention relates to valve assemblies suitable for dispensing containers and, in particular, to valve assemblies suitable for dispensing metered doses of product contained in aerosol containers. Furthermore, this invention relates to the aforementioned valve assemblies (metering valves) utilised in a variety of dispensing apparatus, for example, dispensing apparatus having integral dosage counting devices.

The following invention seeks to provide a new arrangement of valve assembly for pressurised metered dose aerosol containers—suitable for use in dispensing apparatus—which gives rapid chamber surface saturation with components of pharmaceutical formulations, reduces particulate generation and extractables generation, improves the cost-efficiency and ease of manufacture of dispensing apparatus, and provides an indication of the number of actuations of the dispensing apparatus.

Accordingly, in a first aspect the invention provides a metering valve suitable for dispensing a pressurised formulation from a container and comprising a valve stem extending within and slidable relative to a cup-shaped valve body, the valve stem extending through an outer seal closing off an open end of the valve body and carrying an inner seal, a clearance being provided between the outer surface of the inner seal and an inner surface of the valve body to provide a path for the formulation to enter a chamber within the valve body, and a spring urging the valve stem against the outer seal in which movement of the valve stem against the spring action causes the inner seal to engage part of the valve body to define a temporary metering chamber within the body between the outer seal and the inner seal and further depression of the valve stem allows product to flow from the metering chamber to atmosphere, wherein the metering valve further comprises a sealing gasket located, in use, between the metering valve and a container and at least one of the sealing gasket or the inner seal is formed as a co-moulding with at least a part of the valve body or the valve stem, respectively.

The valve body is of stepped cylindrical configuration, in that the inner seal is within a larger diameter portion of the valve body in its rest position and slidably engaging a smaller diameter portion to form the metering chamber. The inner seal is a disc-like seal surrounding and extending outwardly from the valve stem and is, preferably, an annular disc of substantially rectangular cross-section.

The valve stem includes an annular flange. The inner seal is located between the flange and an end of the spring and, preferably, extends radially beyond the flange.

An outer edge of the inner seal may be deflected to allow pressure filling of a container to which the valve is attached.

Advantageously, the sealing gasket is formed as a co-moulding with the larger diameter portion or at least a part of the valve body.

Alternatively, the outer seal may be formed as a co-moulding with the sealing gasket.

The valve body and/or valve stem may be made of a first material and the inner seal, outer seal and/or sealing gasket may be formed of a different material.

The first material is selected from acetal, nylon or polyester.

The different material is selected from polyurethane, thermoplastic vulcanizates, polystyrene polyethylenebutylene block copolymers, polystyrene polybutadiene block copolymers, thermoplastic polyolefin, copolyether ester, polyether block amides, polyethylene copolymers, nitrile, polychloroplene, butyl, chloro-butyl, bromo butyl, EPDM, or a thermoplastic elastomer.

The invention also includes a metering valve for dispensing a pressurised formulation from a container substantially as herein described, with reference to, or as shown in, the accompanying drawings.

An advantage of the valve assembly (metering valve) of the present invention is that it ensures continuous exposure of the metering chamber walls to the pharmaceutical both at rest and during actuation. Continuous exposure allows rapid saturation of the surfaces with the pharmaceutical and, hence, improves drug dose consistency.

According to a second aspect of the present invention, the invention provides a dispensing apparatus suitable for dispensing a pressurised formulation from a container in combination with a metering valve as herein described.

The dispensing apparatus may further comprise a closure, in the form of a ferrule crimped over the metering valve and a container, to retain the metering valve in position on the container, wherein the ferrule is formed from stainless steel and has a thickness of between 0.15 mm and 0.30 mm.

The dispensing apparatus may further comprise a dosage counting device.

Preferably, the dispensing apparatus may further comprise a housing containing a dosage counter comprising at least two annular members and a cog, each mounted rotationally, the housing being suitable for receiving, in use, a container containing a product for dispensation, whereupon each actuation of the apparatus causes the first annular member to incrementally rotate which, after a predetermined number of actuations of the apparatus, causes the cog to rotate, the rotation of the cog causing the second annular member to incrementally rotate.

In use, a longitudinal actuation force applied to the container is converted to a rotational force applied to the first annular member by way of co-operating formations having angled abutment surfaces.

The first annular member is provided with means for affecting rotation of the cog. The rotation means of the first annular member is a notch or protrusion positioned on an outer edge of the first annular member, the notch or protrusion is capable of interacting with a correspondingly-shaped portion of the cog.

Preferably the rotation means of the first annular member is a notch, the cog is turned by way of a tooth catching the notch of the first annular member as the member rotates upon actuation of the apparatus.

Furthermore, when the rotation means of the first annular member is a protrusion, the cog has a correspondingly-shaped notch.

Preferably at least two rotation means are positioned on the outer edge of the first annular member and are positioned ten increments of rotation apart.

Each respective part of the cog which interacts with the first and second annular member has a different number of teeth. Preferably, the ratio of teeth which interact with the first and second annular member is 1:2.

Advantageously the axis of rotation of the cog is positioned offset from the axes of rotation of both the first and second annular members.

The cog may be made of resilient material.

The cog may be resiliently positioned against the outer edge of the first annular member.

Preferably, the first and/or second annular members are provided with markings indicative of the amount or number of doses of product dispensed from, or remaining in, a container received within the apparatus. Most preferably, the markings are numbers or variations of colour and/or tone.

Preferably, the numbering on the first annular member ranges from 0 to 9 and that of the second annular member from 00 to 20, so that when both are seen in combination, a three-figure number is shown.

Each actuation of the apparatus causes the value of the numbering to decrease or augment by a value of one.

The dispensing apparatus may further comprise means for locking-out operation of a container located in the housing.

The apparatus may also comprise third and subsequent annular members, a further cog being provided for each additional annular member.

In use, a predetermined number of rotations of the second or previous annular member causes an incremental rotation of the third or subsequent annular member.

The cog of the dispensing apparatus comprises a hub, with a pivot hole situated in the centre thereof, and a plurality of teeth outwardly-extending from the centre of the cog, the cog being rotatable about a longitudinal axis through the hole, wherein one or more teeth have a reduced-height in the direction of the longitudinal axis, in that upper and lower edges of the tooth are not inline with both upper and lower faces of the cog.

The one or more teeth having a reduced height are half the height of the other teeth. Additionally, the cog comprises a reduced-height tooth interspaced between each pair of non-reduced-height teeth and where all the reduced-height teeth are positioned at either an upper or lower edge of the cog.

Furthermore, the dispensing apparatus is suitable for receiving a non-metering valve-containing container.

The invention also includes a dispensing apparatus suitable for dispensing a pressurised formulation from a container substantially as herein described, with reference to, or as shown in, the accompanying drawings.

The metering valve may further comprise a container, the metering valve being fixed to the container for containing a formulation to be dispensed.

Advantageously, forming the ferrule from stainless steel allows for a simplified manufacturing process for the dispensing apparatus. The stainless steel ferrule does not require a separate anodising step unlike aluminium. Anodising is expensive and, thus, using a stainless steel ferrule leads to a cost reduction compared to an aluminium ferrule. Advantageously, forming the ferrule from stainless steel allows the ferrule to have a decreased thickness compared to a conventional aluminium ferrule which has a typical thickness of 0.40 mm to 0.56 mm.

Advantageously, by forming the inner seal and the valve stem, and/or the valve body and sealing gasket as co-mouldings, the ease of assembly of the metering valve is much improved and the number of assembly steps required in assembling the metering valve is significantly reduced. This has a consequential time and cost savings. Furthermore, it has been shown that there is a need to provide accurate information to a user of dispensing apparatus concerning the number of doses dispensed from, or remaining in, the dispensing apparatus.

In a third aspect, the invention provides a combination comprising a dispensing apparatus of the present invention and a container for containing a formulation to be dispensed located in the housing of the dispensing apparatus.

Preferably, the container is pressurised.

Most preferably, the container contains a pharmaceutical formulation.

The dispensing apparatus may be, and the valve assembly may be used with, for example, a pulmonary, nasal, or sublingual delivery device. A preferred use of the dispensing apparatus and/or valve is in a pharmaceutical metered dose aerosol inhaler device. The term pharmaceutical, as used herein, is intended to encompass any pharmaceutical, compound, composition, medicament, agent or product which can be delivered or administered to a human being or animal, for example, pharmaceuticals, drugs, biological and medicinal products. Examples include antiallergics, analgesics, bronchodilators, antihistamines, therapeutic proteins and peptides, antitussives, anginal preparations, antibiotics, anti-inflammatory preparations, hormones, or sulfonamides, such as, for example, a vasoconstrictive amine, an enzyme, an alkaloid, or a steroid, including combinations of two or more thereof. In particular, examples include isoproterenol [alpha-(isopropylaminomethyl) protocatechuyl alcohol], phenylephrine, phenylpropanolamine, glucagon, adrenochrome, trypsin, epinephrine, ephedrine, narcotine, codeine, atropine, heparin, morphine, dihydromorphinone, ergotamine, scopolamine, methapyrilene, cyanocobalamin, terbutaline, rimiterol, salbutamol, flunisolide, colchicine, pirbuterol, beclomethasone, orciprenaline, fentanyl, and diamorphine, streptomycin, penicillin, procaine penicillin, tetracycline, chlorotetracycline and hydroxytetracycline, adrenocorticotropic hormone and adrenocortical hormones, such as cortisone, hydrocortisone, hydrocortisone acetate and prednisolone, insulin, cromolyn sodium, and mometasone, including combinations of two or more thereof.

The pharmaceutical may be used as either the free base or as one or more salts conventional in the art, such as, for example, acetate, benzenesulphonate, benzoate, bircarbonate, bitartrate, bromide, calcium edetate, camsylate, carbonate, chloride, citrate, dihydrochloride, edetate, edisylate, estolate, esylate, fumarate, fluceptate, gluconate, glutamate, glycollylarsanilate, hexylresorcinate, hydrobromide, hydrochloride, hydroxynaphthoate, iodide, isethionate, lactate, lactobionate, malate, maleate, mandelate, mesylate, methylbromide, methylnitrate, methylsulphate, mucate, napsylate, nitrate, pamoate, (embonate), pantothenate, phosphate, diphosphate, polygalacturonate, salicylate, stearate, subacetate, succinate, sulphate, tannate, tartrate, and triethiodide, including combinations of two or more thereof. Cationic salts may also be used, for example the alkali metals, e.g. Na and K, and ammonium salts and salts of amines known in the art to be pharmaceutically acceptable, for example glycine, ethylene diamine, choline, diethanolamine, triethanolamine, octadecylamine, diethylamine, triethylamine, 1-amino-2-propanol-amino-2-(hydroxymethyl)propane-1,3-diol, and 1-(3,4-dihydroxyphenyl)-2 isopropylaminoethanol.

The pharmaceutical will typically be one which is suitable for inhalation and may be provided in any suitable form for this purpose, for example, as a solution or powder suspension in a solvent or carrier liquid, for example ethanol, or isopropyl alcohol. Typical propellants are HFA134a, HFA227 and dimethyl ether.

The pharmaceutical may, for example, be one which is suitable for the treatment of asthma. Examples include salbutamol, beclomethasone, salmeterol, fluticasone, formoterol, terbutaline, sodium chromoglycate, budesonide and flunisolide, and physiologically acceptable salts (for example salbutamol sulphate, salmeterol xinafoate, fluticasone propionate, beclomethasone dipropionate, and terbutaline sulphate), solvates and esters, including combinations of two or more thereof. Individual isomers, such as, for example, R-salbutamol, may also be used. As will be appreciated, the pharmaceutical may comprise one or more active ingredients, an example of which is flutiform, and may optionally be provided together with a suitable carrier, for example a liquid carrier. One or more surfactants may be included if desired.

In order that the invention may be fully disclosed, embodiments of the invention will now be described, by way of example only, with reference to the accompanying drawings, in which.

FIGS. 1 to 4 show a valve assembly (metering valve), indicated generally at 1, held in position to seal a container 14 by a ferrule 7, which is crimped to an open neck of the container 14. An elastomer sealing gasket 8 is trapped between the open neck of the container 14 and a part of the ferrule 7, such that leakage from the container 14 of a product 17 is prevented. Typically, the product 17 within the container 14 is a pharmaceutical.

Figure 1:
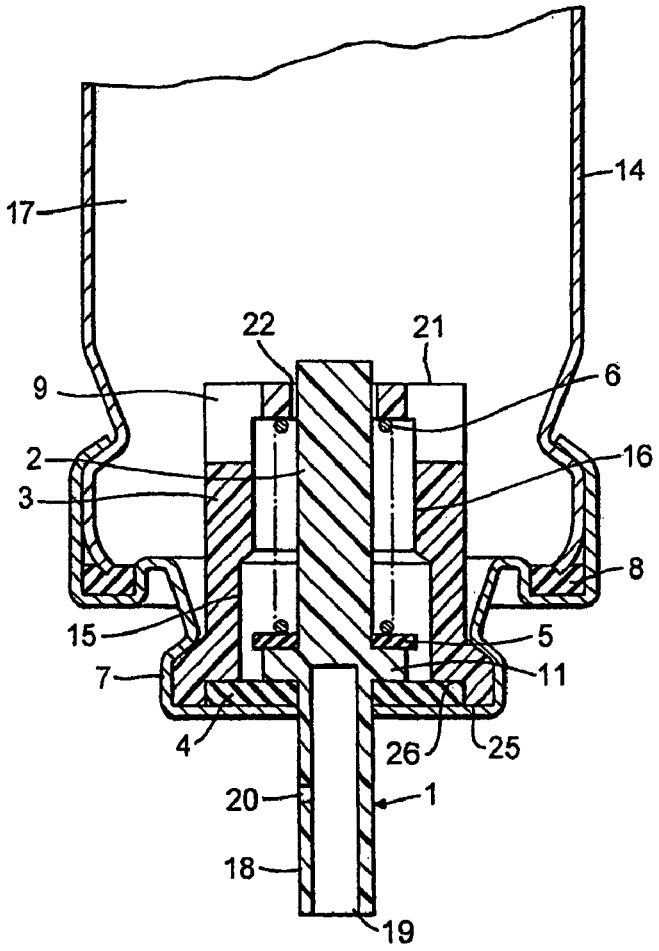
FIG. 1 is a sectional view of the valve assembly (metering valve) in accordance with the invention, in which the valve is shown in a closed, non-dispensing position.
Figure 2:
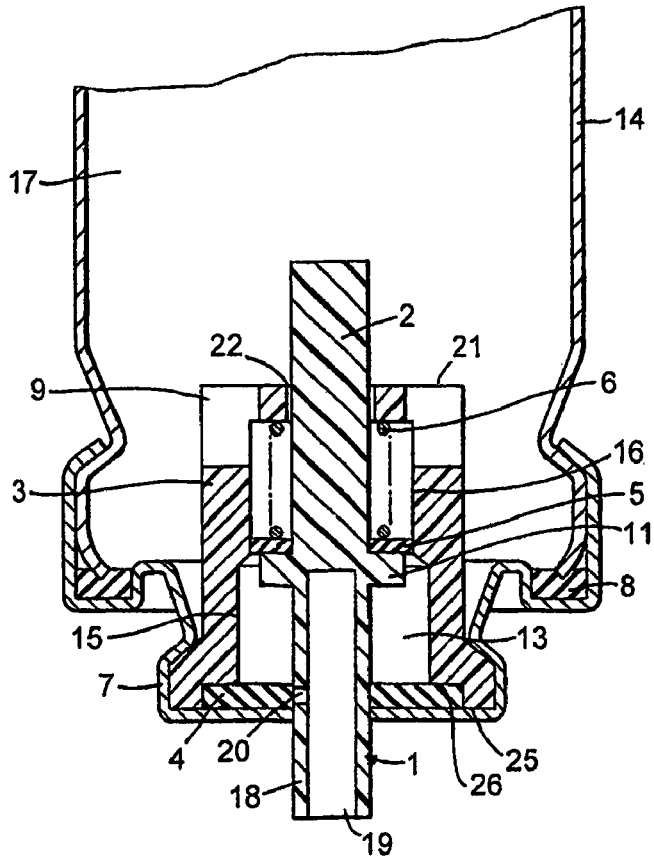
FIG. 2 is a sectional view of the metering valve of FIG. 1 in a chamber formed position.

The main components of the metering valve 1 are a valve stem 2, a valve body 3, an outer seal 4, an inner seal 5 and a spring 6, urging the valve stem 2 into the position shown in FIG. 1.

In the description and claims, the term "inner" is used to mean being relatively remote from a dispensing end of the valve stem 2. The term "outer" is used to mean being relatively proximate a dispensing end of the valve stem 2.

The valve stem 2 is of generally elongate cylindrical shape having a radially-extending flange 11 in a middle portion of the valve stem 2 and including a hollow tubular portion 18 which extends through the outer seal 4 and is open at its outer end 19. The tubular portion includes a side hole 20. In addition, the valve stem 2 includes the inner seal 5 located and/or held against a surface of the flange 11 remote from the outer seal 4 by the spring 6, which is located between the inner seal 5 and an inner surface of the closed end 21 of the valve body 3. Preferably, the inner seal 5 is formed as a co-moulding with the valve stem 2. The inner diameter of the inner seal 5 is a close fit around the valve stem 2 and the outer diameter of the inner seal 5 is such that it extends beyond the outer edge of the annular flange 11.

The valve body 3 is a cup-shaped body of stepped cylindrical configuration having a larger diameter portion 15 and a smaller diameter portion 16. A closed end 21 of the valve body 3—which is adjacent to the smaller diameter portion 16—has a central aperture 22 through which an end of the valve stem 2 slides, the closed end 21 including apertures 9 to provide flow of product 17 from within the container 14 into the interior of the valve body 3. An open end 25 of the valve body 3 includes a recess 26, which provides a seat for the outer seal 4, the outer seal 4 being trapped between the seat 26 and inner surface of the ferrule 7. The larger diameter portion 15 of the valve body provides a clearance between its inner surface and the outer diameter of inner seal 5. The smaller diameter portion 16 of the valve body 3 is of such a size that the inner seal 5 comes into sliding sealing engagement with the smaller diameter portion 16 as the valve stem 2 is depressed within the valve body 3 from the position shown in FIG. 1.

At rest, as shown in FIG. 1, the spring 6 urges the valve stem 2 into the position shown in FIG. 1, such that the flange 11 is held against outer seal 4. In this position, product within the container 17 may flow into the interior of the valve body 3 through the apertures 9.

The valve stem 2 is located coaxially within the valve 1 by the centre hole in the ferrule 7 and the centre hole 22 in the valve body 3. The hollow part of the valve stem 2 is in sliding and sealing engagement with the outer seal 4.

The valve body 3 and valve stem 2 may be made of any suitable material, and are preferably made of a polymeric material such as nylon, polyester or POM. Alternatively, the valve body 3 and valve stem 2 may be manufactured from stainless steel. However, it will, of course, be realised that, when utilising a stainless steel valve stem 2 or valve body 3, co-moulding of respective parts is not possible.

The inner and outer seals 5,4 and, preferably, the sealing gasket 8, are made from any of:

- polyurethane (aromatic polyether or aromatic polyester);
- thermoplastic vulcanizates (being a blend of a plastic part selected from polypropylene, polyethylene or polystyrene and a crosslinked elastomer selected from polyisprene, polybutadiene, polyethylene propylene, polychloroprene, polyacrylonitrile butadiene,
- polyisobutyl or other crosslinkable elastomers);
- polystyrene polyethylenebutylene block copolymers;
- polystyrene polybutadiene block copolymers;
- thermoplastic polyolefin (such as ethlyene propylene rubber);
- co polyether ester;
- polyether block amides;
- polyethylene copolymers;
- nitrile;
- butyl;
- polychloroprene;
- butyl;
- chloro-butyl;
- bromo-butyl;
- EPDM; or
- Thermoplastic elastomer.

The ferrule 7 is preferably made of stainless steel and of a thickness of between 0.15 mm and 0.30 mm.

In the description and claims, the term co-moulded is used to mean that the items specified as co-moulded are formed as a single unitary component by means of a co-moulding manufacturing process. Typically, such a co-moulding manufacturing process involves two or more moulding steps. A first mould shape is formed by a mould tool and a first material is injection moulded into the mould shape to form the core component of the co-moulding. A second mould shape is then formed which contains the core component. Preferably, the same mould tool is used to form the first and second mould shapes by means of actively controlled components of the mould tool which may be moved relative to one another to vary the configuration of the mould shape and to provide the necessary flow paths for the injection process. A second material is then injected into the second mould shape to form the co-moulding. Since the core component is present in the second mould shape, the second material and the core component are intimately moulded together such that a strong mechanical bond is achieved.

In use of the valve assembly, movement of the valve stem 2 against the action of the spring 6 causes the flange 11 and inner seal 5 to move away from the outer seal 4. Continued depression of the valve stem 2 causes the inner seal 5 to engage with the smaller diameter portion 16 of the valve body 3. At this position (shown in FIG. 2), a temporary metering chamber 13 is created within the valve body 3 between inner seal 5 and outer seal 4.

Figure 3:
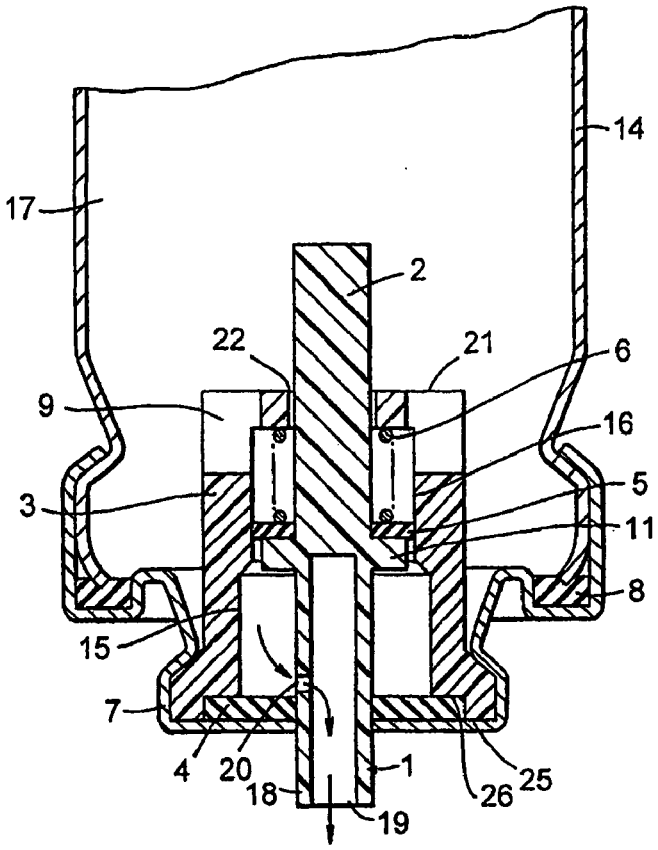
FIG. 3 is sectional view of the metering valve of FIG. 1 in a dispensing position.

Further depression of the valve stem 2 to the position shown in FIG. 3 causes the side hole or port 20 to pass through the outer seal 4. This port 20 provides an exit passage for the product within the metering chamber 13 which is dispensed to the atmosphere, via port 20 and hollow section 18 of the valve stem 2.

Figure 4:
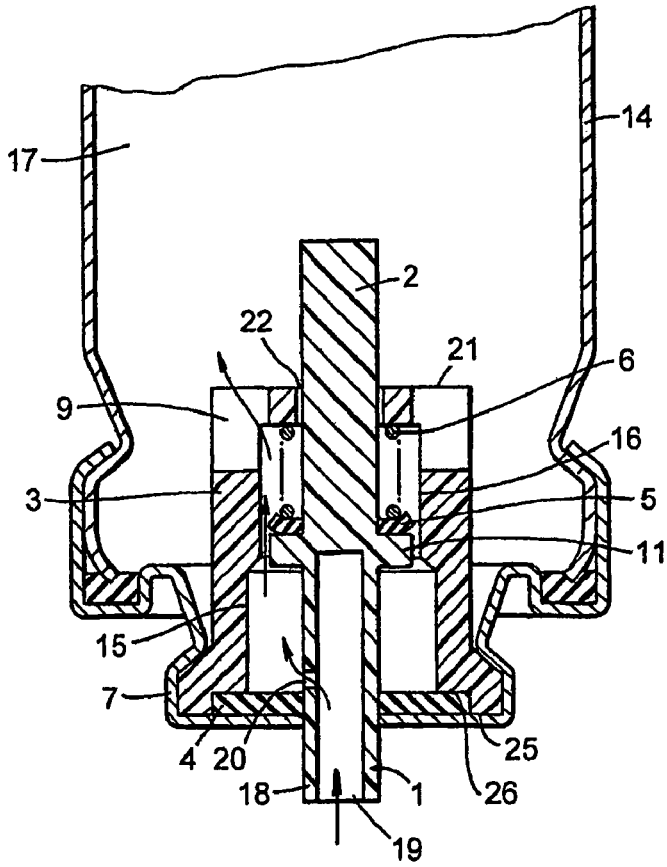
FIG. 4 is a sectional view of the metering valve of FIG. 1 in a pressure filling position.

FIG. 4 illustrates the way in which the container 14 is pressure filled through the metering valve 1. At maximum displacement of the valve stem 2 within the valve body 3, the metering valve 1 is in a position shown in FIG. 4. In this position, product 17 is inserted into the container 14 by a pressure filling head, the filling being shown schematically in FIG. 4. The product 17 passes through the hollow section 18 of valve stem 2, through the port 20 and into the interior of the valve body 3. As shown in FIG. 4, the outer edge of inner seal 5 is deflected by the pressure of the product 17 being inserted into the container 14 from the filling machine and passes around the deflected edge of inner seal 5 along a clearance between the inner surface of the smaller diameter portion 16 of the valve body 3 and the inner seal 5 then into the container 14, via the apertures 9.

Figure 5:
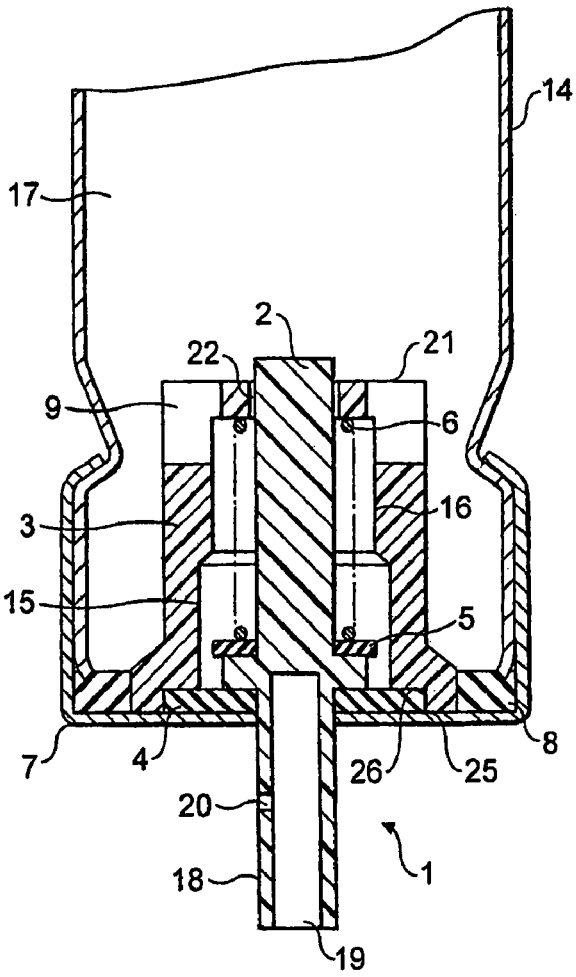
FIGS. 5 and 5A show sectional views of alternative embodiments of valve assembly in accordance with the invention, in which the metering valve is shown in a closed, non-dispensing position.
Figure 5A:
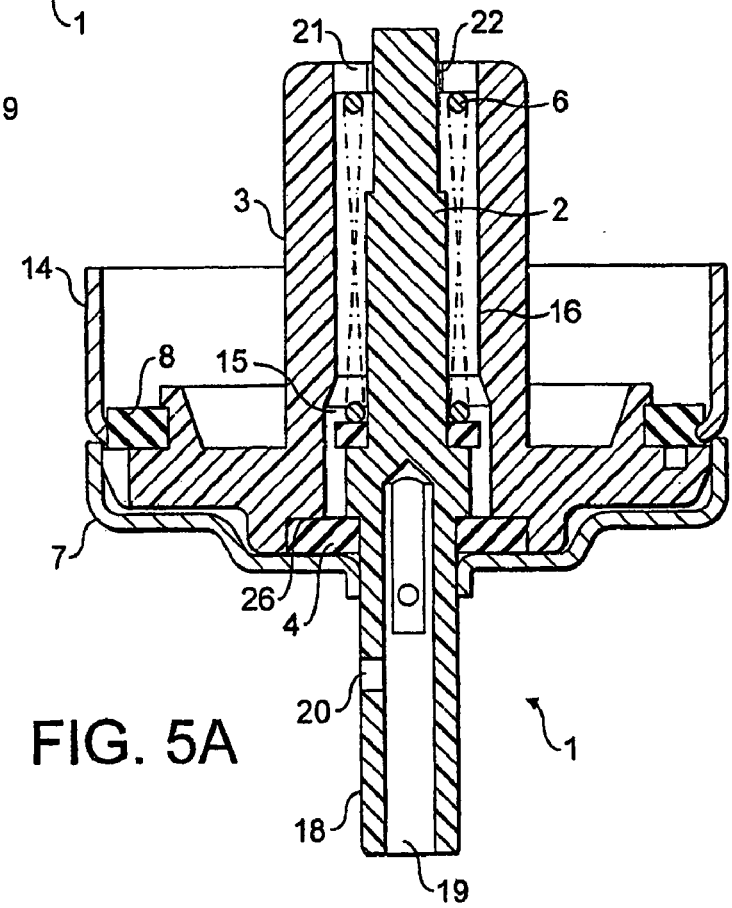

In a second embodiment of the invention—as shown in FIGS. 5 and 5A, and in which identical items from the first embodiment are numbered with like reference numerals—the sealing gasket 8 may be formed as a co-moulding with the valve body 3. FIG. 5A shows, in particular, an alternative arrangement of ferrule 7 for holding the metering valve 1 in the correct position.

Alternatively, but not shown in the drawings, the outer seal 4 may be formed as a co-moulding with the sealing gasket 8.

Typically, valve assemblies of the present invention are utilised in dispensing apparatus as shown in a third embodiment of the present invention, in which a dispensing apparatus comprises a valve assembly of the first and second embodiments of the invention. Furthermore, it has been shown that there is a need to provide accurate information to a user of dispensing apparatus concerning the number of doses dispensed from, or remaining in, the dispensing apparatus.

In FIGS. 6 to 13, identical items from the first and second embodiments are numbered with like reference numerals.

Figure 6:
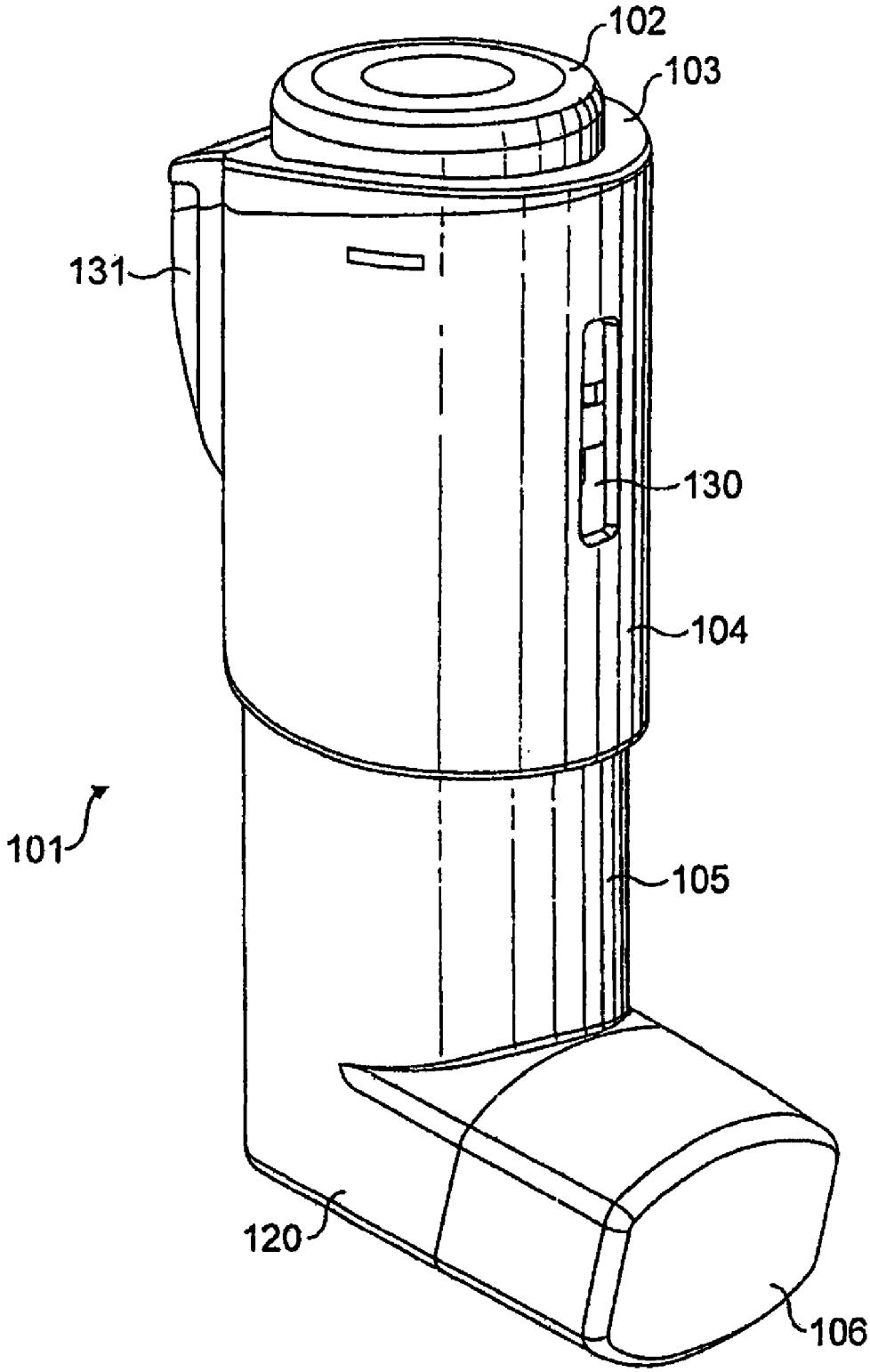
FIG. 6 is a perspective view of a dispensing apparatus in accordance with the present invention.

FIG. 6 shows a dispensing apparatus, indicated generally at 101, having a cap 102, a fixing collar 103, a counter body 104, a main body 105 and a dust cap 106.

Figure 7:
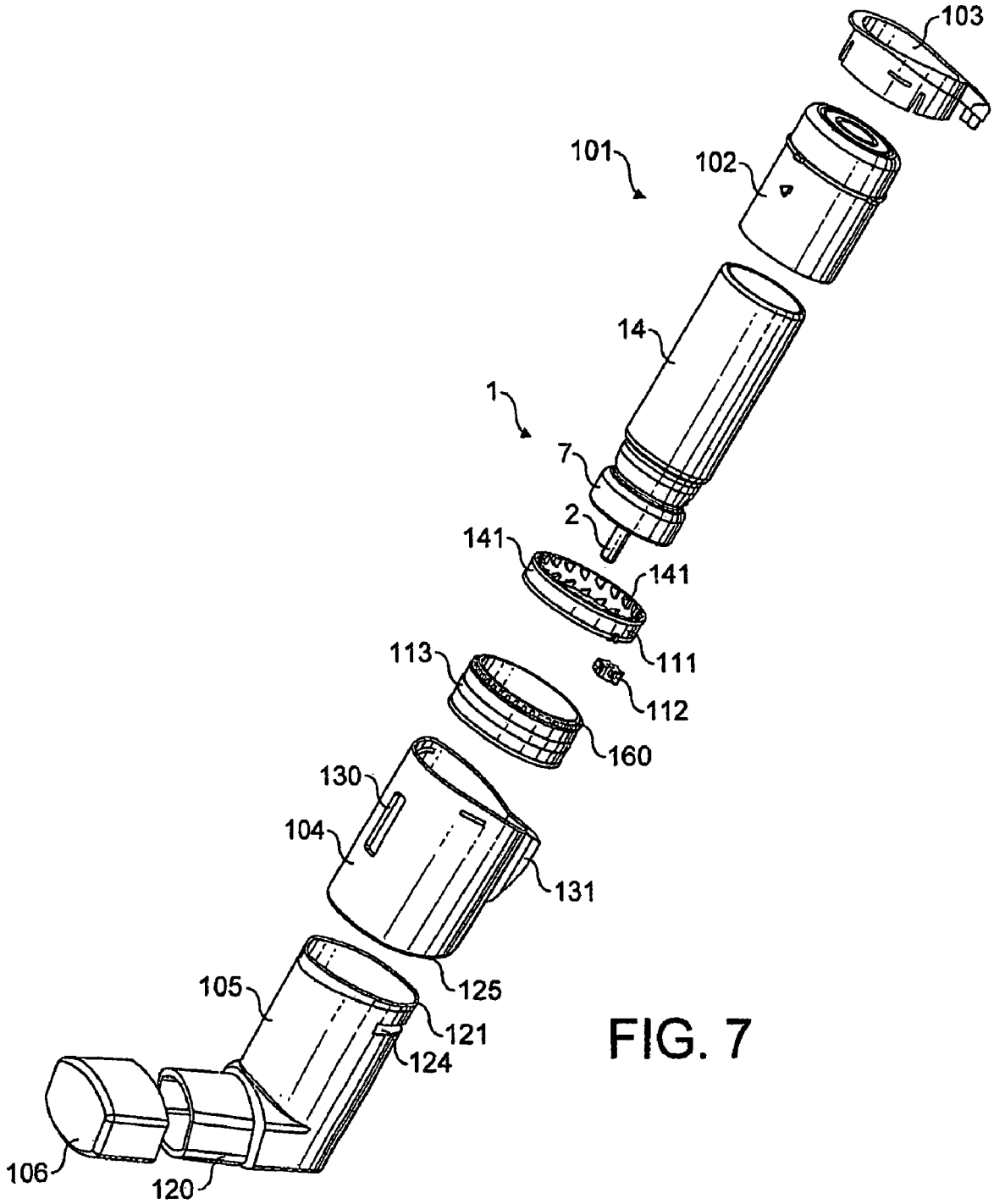
FIG. 7 is an exploded view of the dispensing apparatus of FIG. 6.
Figure 8:
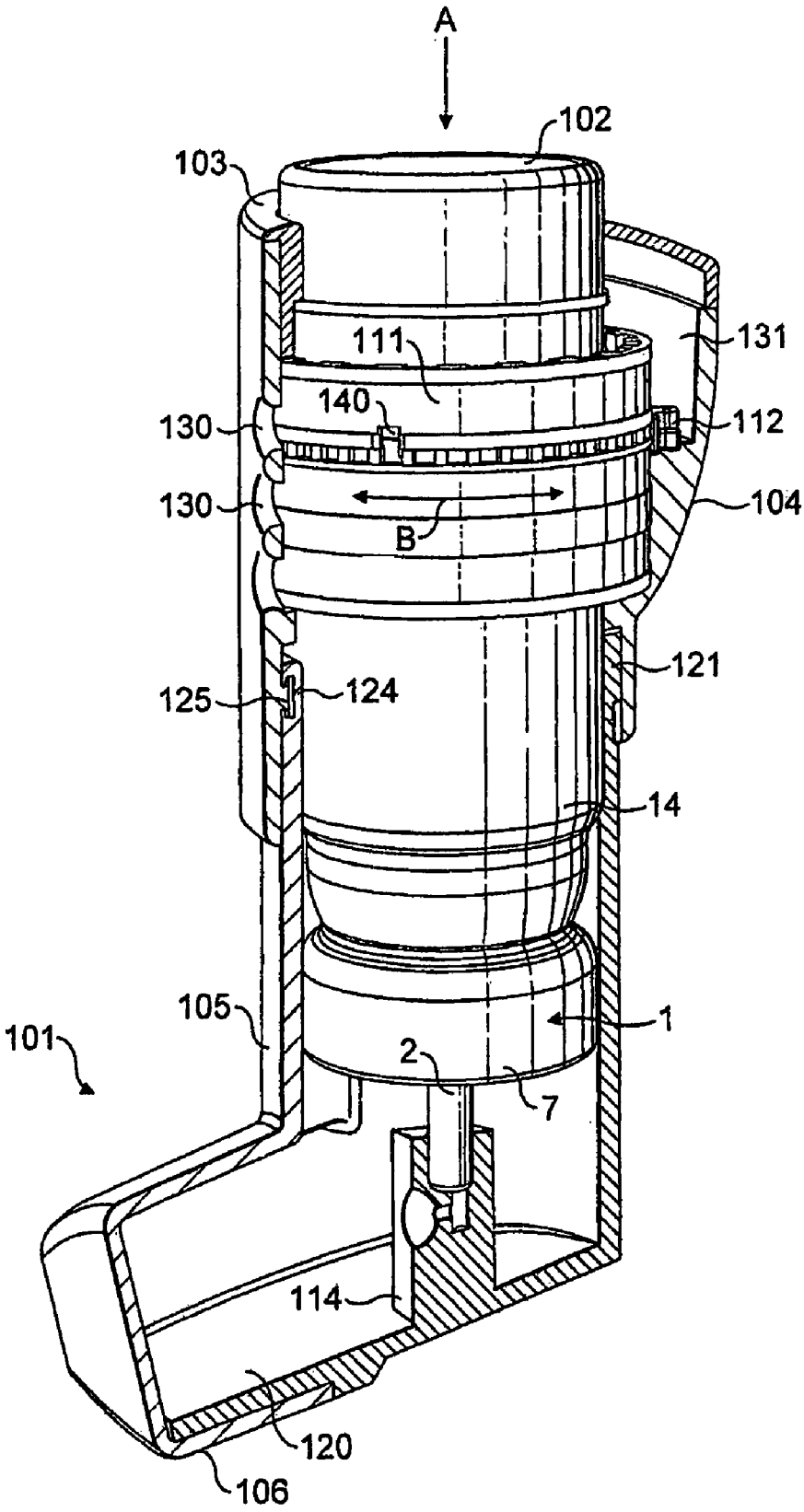
FIG. 8 is a partial cross-sectional view of the dispensing apparatus of FIG. 6.

FIGS. 7 and 8 show internal features of the dispensing apparatus of FIG. 6, wherein the apparatus comprises, a first number ring 111 (first annular member), a cog 112, a second number ring 113 (second annular member) and a valve stem receiving block 114. A separate container of product 14 is also shown.

Referring to FIGS. 6 to 10, the main body 105, which is substantially cylindrical, is provided with an elongate mouthpiece 120, the end of which may be covered by the dust cap 106, and an open end 121 situated at the other end of the main body 105 from the mouthpiece 120. The valve stem receiving block 114 is positioned within the main body 105 so that it may receive a valve stem 2 of the container 14—which may be inserted into position through the open end 121—and is positioned so that, when the apparatus 101 is actuated, the product is dispensed through the mouthpiece 120 and out of the dispensing apparatus. The container 14 also comprises a valve assembly (metering valve) 1 which is retained by means of a ferrule 7. A valve stem 2 extends from the metering valve 1 so that metered doses of product 17 can be dispensed therethrough on actuation of the valve mechanism. The main body 105 also comprises a first functional part of a twist-fit arrangement 124 located adjacent the open end 121.

Figure 11:
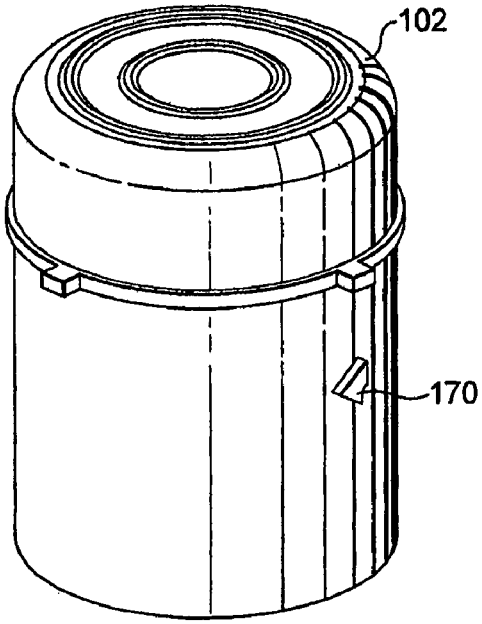
FIG. 11 is a perspective view of the top and one side of a cap of the dispensing apparatus of FIG. 6.
Figure 12:
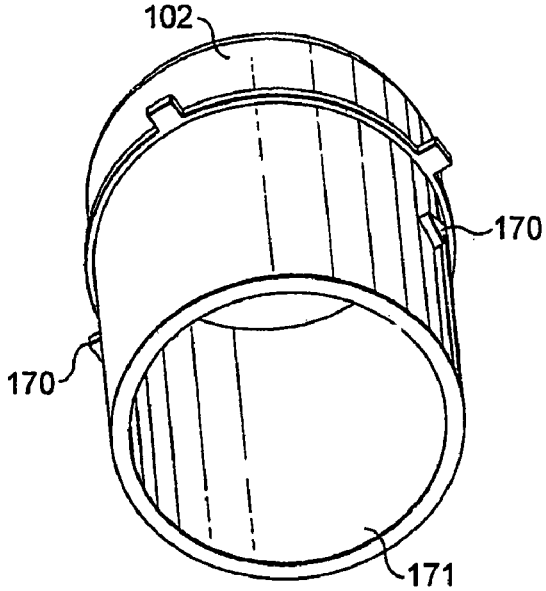
FIG. 12 is a perspective view of the bottom and one side of a cap of the dispensing apparatus of FIG. 6.
Figure 13:
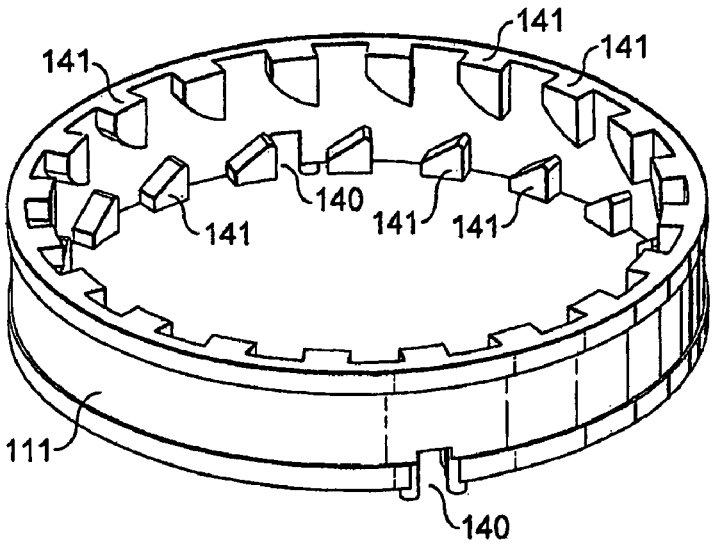
FIG. 13 is a perspective view of a first number ring of the dispensing apparatus of FIG. 6.

The counter body 104, which is substantially cylindrical, further comprises one or more apertures 130 through the side of the counter body 104 and an enlarged portion 131, and is open at both upper and lower ends. The enlarged portion 131, situated at the upper end thereof, houses the cog 112 and the first and second number rings 111,113. The axis of the cog 112 is offset from the axes of the numbered rings 111,113 so that the cog 112 can interact with both number rings 111,113 which are housed in the substantially cylindrical part of the counter body 104 without impeding axial movement of the container 14. The cap 102 is positioned at the upper end of the counter body 104 and overlies an upper end of the container 14. The cap 102 is axially slidable within the counter body 104 so that it may interact with the first number ring 111. The cap 102 and first number ring 111 have co-operating formations 141 having angled abutment surfaces which can interact with each other upon actuation of the apparatus 101. FIGS. 11 to 13 show in more detail the co-operating formations. In particular, the cap 102, which is substantially cylindrical, is provided with one or more substantially triangular teeth 170 (angled abutment surfaces), equally spaced around the outer circumference of the cap 102 and is open at a lower end 171, so that an end of a container 14 may be inserted therein. The first number ring 111 comprises at least one notch 140 positioned on the outer edge thereof and angled abutment surfaces 141 which can co-operate with the corresponding substantially triangular teeth 170 of the cap 102. The first number ring 111 is also provided with a set of numbering from 0 to 9 for each notch 140, so that after the ninth actuation of the apparatus 101, the notch 140 is in position to interact with the cog 112. In a preferred embodiment, the number ring 111 will have two notches 140 and, so, will have two sets of numbering from 0 to 9.

The cap 102, the cog 112 and the first and second number rings 111,113 are held within the counter body 104 by a fixing collar 103, which forms a push-fit connection with the upper end of the counter body 104. The counter body 104 also comprises a second functional part of a twist-fit arrangement 125 situated internally and adjacent the lower-end of the counter body.

Figure 9:
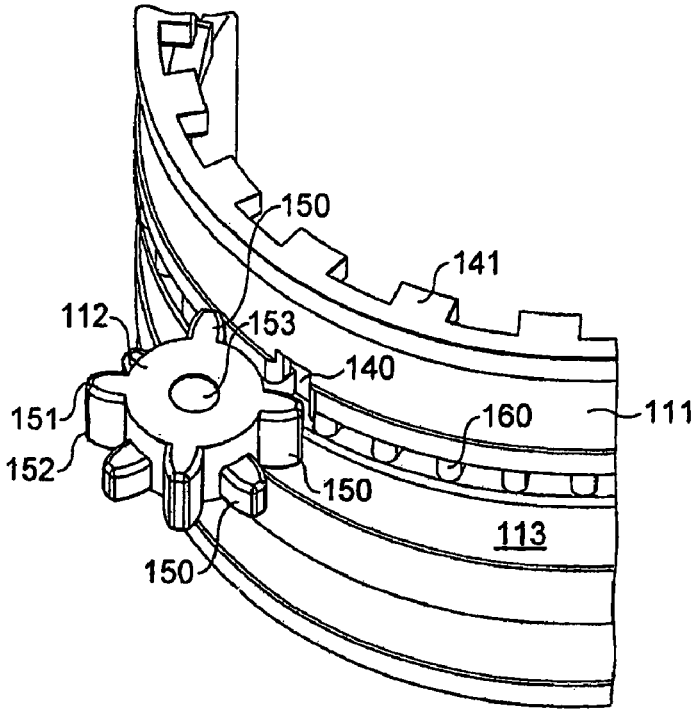
FIG. 9 shows first and second number rings and a cog of the dispensing apparatus of FIG. 6.
Figure 10:
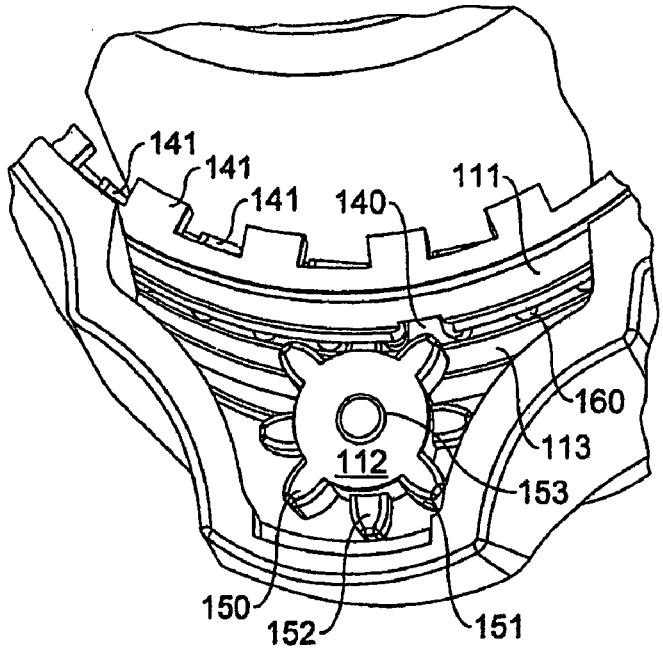
FIG. 10 is a partial-plan view of the dispensing apparatus of FIG. 6.

The cog 112, as more clearly shown in FIGS. 9 and 10, is provided with a hole 153 situated in the centre thereof, and a plurality of teeth 150 outwardly-extending from the centre of the cog 112. The cog 112 is rotatably mounted about a longitudinal axis through the hole 153. Each alternate tooth 150 has a reduced-height in the direction of the longitudinal axis in that upper and lower edges of the teeth 150 are not inline with both upper and lower faces of the cog 112. The cog 112 is, therefore, arranged so that when there are eight teeth 150 on a lower row of teeth 152, an upper row of teeth 151 has only four teeth 150. The upper and lower rows of teeth 151,152 are arranged such that they interact only with the first and second number rings 111,113, respectively. In an alternative, the upper and lower teeth 150 may be misaligned in the form of two distinct rows, or, indeed, the upper teeth 150 may be extensions of some of the lower teeth 150, as shown in FIGS. 9 and 10.

The second number ring 113 is provided with a plurality of teeth 160, positioned adjacent an upper edge of the number ring 113, and numbering on the outside of the number ring 113. The numbering ranges from 00 to 20, the distance between each number corresponding to the distance between two teeth 160.

The apertures 130 are positioned such that numbering on the outside of the number rings 111,113 can be seen by a user. In an alternative embodiment, only numbering on the second number ring 113 is visible by a user through the apertures 130.

In a further alternative, numbering on the outside of the number rings 111,113 may be substituted for markings, such as variations of colours and/or tone, or, even, indicators such as Full, ¾, ½, ¾, or Empty, for example.

The main body 105 and the counter body 104 are connected together by means of a twist-fit arrangement using the first and second functional parts 124,125 which hold the two bodies 104,105 together securely. The dust cap 106 is secured to the mouthpiece 120 by means of a push-fit arrangement.

Referring to FIGS. 6 to 13, in use, a container 14 can be loaded into position within the apparatus 101 by twisting apart the counter body 104 and the main body 105 and pushing a container 14, valve stem 2 first, into the opening of the main body 121, and positioning the valve stem 2 into the valve stem receiving block 114.

Actuation of the apparatus 101, by depression of the cap 102 in the direction of Arrow A, causes an amount of product to be dispensed from the container 14 by an opposite reaction force from the valve stem receiving block 114 acting on the valve stem 2, which is inwardly retracted relative to the remainder of the metering valve 1 such that an amount of product is dispensed from the valve stem 2 through the valve stem receiving block 114, from where it is dispensed as an aerosol through the mouthpiece 120 and inhaled by a user inhaling on the mouthpiece 120. Release of the cap 102 causes the cap 102 and the container 14 to return to its starting position, owing to the internal spring bias of the metering valve 1, ready for subsequent dispensing.

Each actuation of the apparatus 101 causes the first number ring 111 to incrementally rotate in only one of either direction of Arrow B continuously, owing to engagement of the co-operating formations having angled abutment surfaces between the cap 102 and the first number ring 111.

Every ten actuations of the apparatus 101 cause a notch 140 to pass the cog 112, the effect of this being that a tooth 150 of the upper row of teeth 151 is caught in the notch 140 as it rotates, this rotation causes a corresponding opposite rotation of the cog 112, the second number ring 113 being caused to rotate in the same direction as the first number ring 111. Therefore, it can be seen that every actuation of the apparatus causes the value of the numbering visible through the one or more apertures 130 to be decreased or augmented by a value of one.

In an alternative embodiment, the dispensing apparatus may comprise, say, three or more number rings: a first number ring for 'units', a second for 'tens' and a third for 'hundreds'. Subsequent number rings for 'thousands' and so on may also be added. The second and subsequent number rings are rotated by an arrangement as described herein, whereby ten incremental rotations of the previous number ring—as started originally on the 'units' number ring by actuation of the apparatus—causes an incremental rotation of the subsequent number ring.

In an alternative embodiment, the metering valve of the present invention may be fixedly located within a dispensing apparatus of the present invention, such that the dispensing apparatus is suitable for receiving a non-metering valve-containing container.

Whilst in the specific example details of the invention are discussed, it will of course be understood that minor variations in features are still considered to be covered by the same inventive concept. For example, the inner seal 5 may be of cross-sections other than rectangular provided the seal is still generally disc like and extends beyond the flange 11.

The invention claimed is:

1. A metering valve suitable for dispensing a pressurised product from a container and comprising a valve stem extending within and slidable relative to a cup-shaped valve body, the valve stem extending through an outer seal closing off an open end of the valve body and carrying an inner seal, a clearance being provided between the outer surface of the inner seal and an inner surface of the valve body to provide a path for the product to enter a chamber within the valve body, and a spring urging the valve stem against the outer seal in which movement of the valve stem against the spring action causes the inner seal to engage part of the valve body to define a temporary metering chamber within the valve body between the outer seal and the inner seal and further depression of the valve stem allows product to flow from the metering chamber to atmosphere, the metering valve further comprises a sealing gasket located, in use, between the valve body and the container to which the metering valve is attached and wherein at least one of the sealing gasket or the inner seal is formed as a co-moulding with at least a part of the valve body or the valve stem, respectively, the valve stem further comprising an annular flange, the inner seal being located between the flange and an end of the spring, the inner seal extending radially beyond the flange, and wherein the spring contacts the inner seal, and wherein an outer edge of the inner seal is a disc-like seal, surrounding and extending outwardly from the valve stem, and deflectable to allow pressure filling of the container to which the valve is attached, the product, while on route to pressure filling the container, passing around the deflected edge of the inner seal along a clearance space provided between the inner seal and a smaller diameter portion of the inner surface of the valve body.

2. A metering valve as claimed in claim 1, in which the valve body is of stepped cylindrical configuration, the inner seal being within a larger diameter portion of the valve body in its rest position and slidably engaging the smaller diameter portion to form the metering chamber.

3. A metering valve as claimed in claim 2, wherein the sealing gasket is formed as a co-moulding with the larger diameter portion.

4. A metering valve as claimed in claim 1, in which the inner seal is an annular disc of substantially rectangular cross-section.

5. A metering valve as claimed in claim 1, wherein the outer seal is formed as a co-moulding with the sealing gasket.

6. A metering valve as claimed in claim 1, wherein the valve body and/or valve stem is made of a first material and the inner seal, outer seal and/or sealing gasket is formed of a different material.

7. A metering valve as claimed in claim 6, wherein the first material is selected from acetal, nylon or polyester.

8. A metering valve as claimed in claim 6, wherein the different material is selected from polyurethane, thermoplastic vulcanizates, polystyrene polyethylenebutylene block copolymers, polystyrene polybutadiene block copolymers, thermoplastic polyolefin, copolyether ester, polyether block amides, polyethylene copolymers, nitrile, polychloroplene, butyl, chloro-butyl, bromo butyl, EPDM, or a thermoplastic elastomer.

9. A dispensing apparatus suitable for dispensing a pressurised product from the container in combination with a metering valve as claimed in claim 1.

10. A dispensing apparatus as claimed in claim 9, further comprising a closure, in the form of a ferrule crimped over the metering valve and the container, to retain the metering valve in position on the container, wherein the ferrule is formed from stainless steel.

11. A dispensing apparatus as claimed in claim 10, wherein the stainless steel ferrule has a thickness of between 0.15 mm and 0.30 mm.

12. A dispensing apparatus as claimed in claim 9 further comprising a dosage counting device.

13. A dispensing apparatus as claimed in claim 9, further comprising a housing containing a dosage counter comprising at least two annular members and a cog, each mounted rotationally, the housing being suitable for receiving, in use, the container containing a product for dispensation, whereupon each actuation of the dispensing apparatus causes the first annular member to incrementally rotate which, after a predetermined number of actuations of the dispensing apparatus, causes the cog to rotate, the rotation of the cog causing the second annular member to incrementally rotate.

14. A dispensing apparatus as claimed in claim 13, wherein a longitudinal actuation force applied, in use, to the container is converted to a rotational force applied to the first annular member by way of co-operating formations having angled abutment surfaces.

15. A dispensing apparatus as claimed in claim 13, wherein the first annular member is provided with rotation means for affecting rotation of the cog.

16. A dispensing apparatus as claimed in claim 15, wherein, when the rotation means of the first annular member is a notch or protrusion positioned on an outer edge of the first annular member, the notch or protrusion is capable of interacting with a correspondingly-shaped portion of the cog.

17. A dispensing apparatus as claimed in claim 16, wherein the rotation means of the first annular member is a notch, the cog is turned by way of a tooth catching the notch of the first annular member as the member rotates upon actuation of the dispensing apparatus.

18. A dispensing apparatus as claimed in claim 16, wherein, the rotation means of the first annular member is a protrusion and the cog has a correspondingly-shaped notch.

19. A dispensing apparatus as claimed in claim 15, wherein at least two rotation means are positioned on the outer edge of the first annular member.

20. A dispensing apparatus as claimed in claim 15, wherein respective rotation means are positioned ten increments of rotation apart.

21. A dispensing apparatus as claimed in claim 13, wherein each respective part of the cog which interacts with the first and second annular member has a different number of teeth.

22. A dispensing apparatus as claimed in claim 21, wherein the ratio of teeth on respective parts of the cog which interact with the first and second annular member is 1:2.

23. A dispensing apparatus as claimed in claim 13, wherein the axis of rotation of the cog is positioned offset from the axes of rotation of both the first and second annular members.

24. A dispensing apparatus as claimed in claim 13, wherein the cog is made of resilient material.

25. A dispensing apparatus as claimed in claim 13, wherein the cog is resiliently positioned against the outer edge of the first annular member.

26. A dispensing apparatus as claimed claim 13, wherein the first and/or second annular members are provided with markings indicative of the amount or number of doses of product dispensed from or remaining in a container received within the dispensing apparatus.

27. A dispensing apparatus as claimed in claim 26, wherein the markings are numbers or variations of colour and/or tone.

28. A dispensing apparatus as claimed in claim 27, wherein numbering on the first annular member ranges from 0 to 9 and that of the second annular member from 00 to 20, so that when both are seen in combination, a three-figure number is shown.

29. A dispensing apparatus as claimed in claim 27, wherein each actuation of the dispensing apparatus causes the value of the numbering to decrease or augment by a value of one or the colour or tone changes.

30. A dispensing apparatus as claimed in claim 13, wherein the dispensing apparatus further comprises third and subsequent annular members, a further cog being provided for the third and each subsequent annular member.

31. A dispensing apparatus as claimed in claim 30, wherein a predetermined number of rotations of the second or previous annular member causes an incremental rotation of the third or subsequent annular member.

32. A dispensing apparatus as claimed in claim 13, wherein the cog comprises a hub, with a pivot hole situated in the centre thereof, and a plurality of teeth outwardly-extending from the centre of the cog, the cog being rotatable about a longitudinal axis through the hole, wherein one or more teeth have a reduced-height in the direction of the longitudinal axis, in that at least one of an upper and lower edge of the tooth is not in-line with at least one of an upper and lower face of the cog.

33. A dispensing apparatus as claimed in claim 32, wherein the one or more teeth having a reduced height are half the height of the other teeth.

34. A dispensing apparatus as claimed in claim 32, wherein the cog comprises a reduced-height tooth interspaced between each pair of non-reduced-height teeth.

35. A dispensing apparatus as claimed in claim 32, wherein all the reduced-height teeth are positioned at either an upper or lower edge of the cog.

36. A combination comprising the container and the dispensing apparatus as claimed in claim 9, the container being a container containing a product to be dispensed and the container being located in a housing of the dispensing apparatus.

37. A combination comprising the container and the metering valve as claimed in claim 1, the metering valve being fixed to the container for containing a product to be dispensed.

38. A combination as claimed in claim 37, wherein the container is pressurised.

39. A combination as claimed in claim 37, wherein the container contains a pharmaceutical formulation as the product.

40. A metering valve as claimed in claim 1 wherein the valve body has flow apertures, and said apertures are arranged such that product flows in a first direction through the apertures during filling of the container following passage of the product past the deflected inner seal.

41. A metering valve as claimed in claim 40 wherein the valve body includes a larger diameter portion of the inner surface of the valve body which borders the smaller diameter portion, and the apertures of the valve body are arranged such that product flows through the apertures in a second direction, which is reverse to the first direction, and then past the clearance provided between the outer surface of the inner seal and the larger diameter portion of the inner surface of the valve body when the metering valve is in a closed, non-dispensing position.

42. A metering valve as recited in claim 41 wherein the apertures are formed at an end region of the valve body farthest removed from a dispensing end of the metering valve and wherein the end region of valve body further includes a valve stem reception aperture within which the valve stem axially slides.

43. A metering valve as claimed in claim 1 wherein said flange has a first surface supporting said inner seal and a second surface axially spaced, in a direction along said valve stem, from said first surface, and said valve stem being configured such that said second surface makes sealing contact with the outer seal when said metering valve is in a rest position.

* * * * *